US005382209A

United States Patent [19]

Pasier et al.

[11] Patent Number: 5,382,209

[45] Date of Patent: Jan. 17, 1995

[54] APPARATUS FOR ADJUSTING INCLINATION OF AN EXERCISE MACHINE

[76] Inventors: Paul A. Pasier, 3331 Mission Ridge La., Atlanta, Ga. 30339; Ravi Y. Navare, 1600 Wilson Way, Suite 7, Symrna, Ga. 30082

[21] Appl. No.: 14,743

[22] Filed: Feb. 8, 1993

[51] Int. Cl.[6] ..... A63B 69/18

[52] U.S. Cl. ..... 482/70; 482/52

[58] Field of Search ..... 482/52, 51, 54, 70, 482/148, 908, 14, 15, 17

[56] References Cited

U.S. PATENT DOCUMENTS

| | | | |
|---|---|---|---|
| D. 123,160 | 10/1940 | Daily . | |
| 2,117,957 | 5/1938 | Heller | 272/69 |
| 2,622,658 | 12/1952 | Morgan | 482/52 |
| 3,107,091 | 10/1963 | Jenkins | 272/59 |
| 4,616,822 | 10/1986 | Trulaske et al. | 272/69 |
| 4,757,987 | 7/1988 | Allemand | 272/69 |
| 4,813,667 | 3/1989 | Watterson | 272/97 |
| 4,844,449 | 7/1989 | Truslaske | 272/69 |
| 5,050,861 | 9/1991 | Thomas | 482/52 |
| 5,058,881 | 10/1991 | Measom | 272/69 |
| 5,110,117 | 5/1992 | Fisher et al. | 482/54 |

*Primary Examiner*—Stephen R. Crow
*Attorney, Agent, or Firm*—Michael Drew

[57] ABSTRACT

A front portion of a pyramid-shaped base (20) has a pair of steps (26,28). Each step (22) has a recessed area (24) that receives the leg (13 ) of an exercise machine (11 ) . A member (30 ) connecting the pair of steps (26,28 ) provides stability.

8 Claims, 1 Drawing Sheet

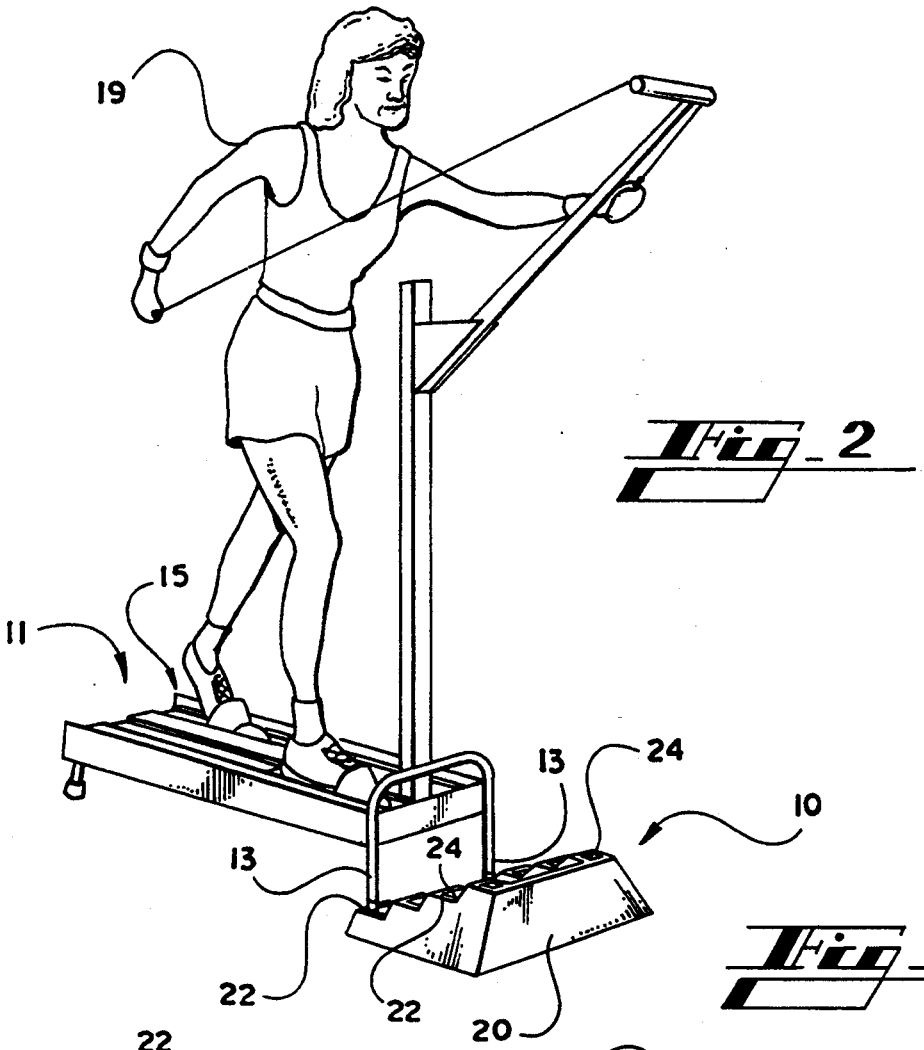
Fig. 2
Fig. 1
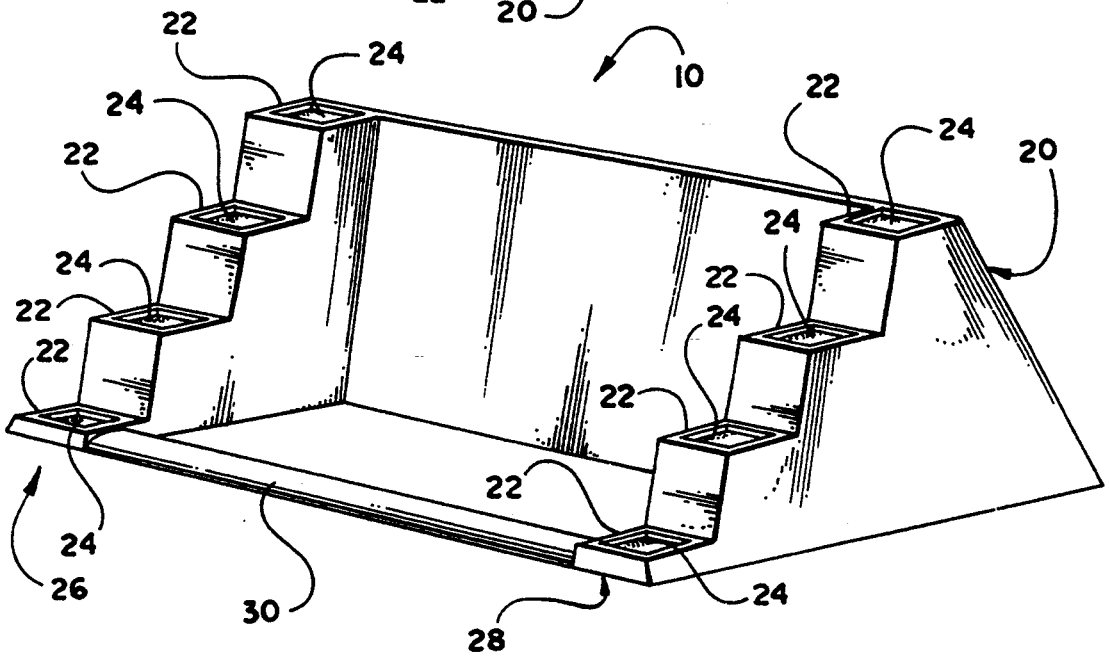

APPARATUS FOR ADJUSTING INCLINATION OF AN EXERCISE MACHINE

TECHNICAL FIELD OF THE INVENTION

The present invention relates to devices for adjusting the angle of inclination of an exercise machine.

BACKGROUND OF THE INVENTION

In a stationary exercise machine such as a sit-up platform, a treadmill, or a cross-country ski simulation device (such as the NordicTrack® skier) the amount of work performed by an individual using the device may be increased or decreased by respectively raising or lowering the angle of inclination of the exercise device. Prior methods for changing the angle of inclination generally involve changing the point of connection between the exercise surface of the machine and the support which rests upon the floor. A problem in adjusting the angle of inclination of an exercise machine in this manner is that the hardware components of the exercise machine must have adjustment mechanisms built into the device. If the exercise machine does not contain built-in adjusting mechanisms, the angle of inclination of the machine cannot be adjusted. Another problem in attempting to adjust the angle of inclination of an exercise machine is that when the machine does contain adjusting mechanisms, the mechanisms are often cumbersome or difficult to use. A simple, reliable means for adjusting the angle of inclination of various types of exercise machines is not presently known.

SUMMARY OF THE INVENTION

It is an object of the invention to provide a means for adjusting the angle of inclination of an exercise machine.

According to a preferred embodiment of the invention, a front portion of a pyramid-shaped base contains a pair of steps, each having a recessed area, for receiving the legs or base of an exercise machine. A connecting member between the front portion of the steps increases stability of the apparatus.

Other aspects, objects, features, and advantages of the present invention will become apparent to those skilled in the art upon reading the detailed description of preferred embodiments.

BRIEF DESCRIPTION OF THE DRAWINGS

FIG. 1 is an isometric illustration of an apparatus for adjusting inclination of an exercise machine according to a preferred embodiment of the invention.

FIG. 2 is an illustration of the invention of FIG. 1 in use with a cross-country skiing simulation-type exercise device.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described with reference to the following description of embodiments taken in conjunction with the accompanying drawings. In the drawings, the same reference numerals are used to refer to like features.

As an overview, the invention uses a pair of connected, self-supporting steps as a means for changing the angle of inclination of an exercise machine. Each series of steps may be generally described as a series of platform-like gradations. The angle of inclination is changed by enabling the front, or rear, of an exercise machine to be raised. The preferred embodiment of the invention receives the support feet or similar type footings of most exercise machines. Referring now to FIG. 1, therein is shown an apparatus 10 for adjusting inclination of an exercise machine according to a preferred embodiment of the invention. A pair of a series 26, 28 of steps 22 is connected. The feet of an exercise machine may be placed upon the steps 22 and maintained in the raised position while the exercise machine is used. In the preferred embodiment illustrated, the front portion of a pyramid-shaped base 20 contains a pair of a series 26, 28 of steps 22. The pyramid-shaped base 20 is extremely stable because the bottom portion of the base 20 which rests upon the floor is wider than any portion which will receive the supporting feet of an exercise machine. Each step 22 contains a recessed area 24 for receiving the feet of an exercise machine. The recess 24 helps prevent a leg, knob or other inserted support portion of an exercise machine from becoming accidentally dislodged during exercise. The apparatus 10 has a stabilizing bar, or member, 30 extending between lowermost steps 22 of the pair of series 26, 28 of steps 22. The pyramid-shaped configuration of the base 20 also provides stability in that the base upon which the exercise machine rests is progressively larger as higher levels of steps 22 are used to hold the exercise machine.

Referring now to FIG. 2, therein is shown the use of the apparatus 10 with an exercise machine 11. The exercise machine 11 illustrated is a cross-country ski simulation type device. The front legs 13 of the exercise machine 11 rest upon the lowermost steps 22 of the apparatus 10. As the legs 13 are placed upon higher levels of steps 22, the angle of inclination of the work surface, or support surface, 15 of the exercise machine 11 is progressively increased causing the individual 19 using the machine 11 to perform greater amounts of work while exercising. The apparatus 10 functions with any exercise machine having feet or similar support members wherein an individual using the machine performs greater amounts of work if the angle of inclination of the machine is increased by raising the front or rear portion of the machine. The illustration of FIG. 2 shows the front of the exercise machine 11 raised. However, the apparatus 10 may be used to raise the rear of an exercise machine 11 by receiving the rear feet of the machine, and thereby changing the angle of inclination from a rear perspective. Depending upon the type of exercise performed, raising the rear of an exercise machine 11 may either decrease or increase the amount of work performed by an individual.

The advantage of the apparatus 10 is that it can be used with any exercise machine 11 which has feet or similar members that may be received by the recesses 24 of the steps 22 of the apparatus 10. Most exercise machines 11 have either feet or foot-like protrusions at the bottom of the exercise machine 11. Another advantage of the apparatus 10 is that it is very easy to change the angle of inclination of the exercise machine 11 by simply lifting the legs 13 from the floor and sliding the apparatus 10 into place. The amount of increased work to be performed on the elevated machine is determined by the level of steps 22 chosen. The machine 11 is well-stabilized because the apparatus 10 does not easily move. As discussed above, the apparatus 10 is very stable because of the pyramid-shaped configuration of the base 20. Also as discussed above, the stabilizing member 30 adds to the reliability of the apparatus 10 by inhibiting movement of the pair of steps 20 with respect to one another. The weight of the individual 19 and exercise machine 11 act to further stabilize the apparatus 10 because of the downward force resulting from these weights. As previously mentioned, the legs 13 of the exercise machine 11 are not easily dislodged from the apparatus 10 because of the recesses 24 in the steps 22. The apparatus 10 will also accommodate a horizontal base which may be set upon the steps. The apparatus 10 may be made from a variety of materials. Suitable light-weight yet durable, sturdy materials include neoprene rubber, polyeurethane, graphite composites and fiberglass.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. An apparatus for adjusting inclination of an exercise machine comprising:

a parallel pair of a series of platform-like gradations having levels of said platform-like gradations of one said series corresponding to levels of said platform-like gradations of an other said series, each said platform-like gradation having means adapted for receiving a support leg of the exercise machine; and means for connecting said pair of a series of platform-like gradations and for preventing movement of said pair of a series of platform-like gradations with respect to one another.

2. The invention of claim 1, said means for connecting said pair of a series of platform-like gradations and for preventing movement of said pair of a series of platform-like gradations with respect to one another comprising a pyramid-shaped base having said parallel pair of a series of platform-like gradations defined upon a front surface thereof.

3. The invention of claim 2, further comprising means for connecting lowermost steps of said pair of a series of platform-like gradations.

4. The invention of claim 3, said means for connecting lowermost steps of said pair of a series of platform-like gradations comprising a member connecting lowermost steps of said pair of a series of platform-like gradations.

5. An apparatus for adjusting inclination of an exercise machine comprising:

a pyramid-shaped base having a front-most surface defining a parallel pair of a series of platform-like gradations having levels of said platform-like gradations of one said series corresponding to levels of said platform-like gradations of an other said series, each said platform-like gradation defining a recess adapted for receiving a support leg of the exercise machine; and means for connecting lowermost platform-like gradations of said parallel pair of a series of platform-like gradations.

6. The invention of claim 5, said means for connecting lowermost platform-like gradations comprising a member connecting said lowermost platform-like gradations.

7. The invention of claim 1, wherein the support leg of the exercise machine is generally vertically oriented.

8. The invention of claim 5, wherein the support leg of the exercise machine is generally vertically oriented.

* * * * *